US008998585B2

(12) United States Patent
Short

(10) Patent No.: US 8,998,585 B2
(45) Date of Patent: Apr. 7, 2015

(54) LIQUID PUMP APPARATUS AND METHOD

(75) Inventor: Gary Short, Alfreton (GB)

(73) Assignee: Coldharbour Marine Limited (GB)

( * ) Notice: Subject to any disclaimer, the term of this patent is extended or adjusted under 35 U.S.C. 154(b) by 10 days.

(21) Appl. No.: 13/376,507

(22) PCT Filed: May 10, 2010

(86) PCT No.: PCT/GB2010/050751

§ 371 (c)(1),
(2), (4) Date: Dec. 6, 2011

(87) PCT Pub. No.: WO2010/128336

PCT Pub. Date: Nov. 11, 2010

(65) Prior Publication Data

US 2012/0091071 A1 Apr. 19, 2012

(30) Foreign Application Priority Data

May 8, 2009 (GB) ..... 0907944.3

(51) Int. Cl.
*F04D 9/06* (2006.01)
*F04F 1/18* (2006.01)
*B63J 4/00* (2006.01)

(52) U.S. Cl.
CPC ... *F04F 1/18* (2013.01); *B63J 4/002* (2013.01)

(58) Field of Classification Search
CPC ..... F04D 9/001; F04D 9/06; F04F 1/06; F04F 5/54; C02F 1/20; C02F 2103/008
USPC ..... 417/108, 116, 117, 90, 91, 109, 111; 114/125
See application file for complete search history.

(56) References Cited

U.S. PATENT DOCUMENTS

| | | | | |
|---|---|---|---|---|
| 347,196 | A | 8/1886 | Pohle | |
| 1,054,629 | A | 2/1913 | Warwick | |
| 1,604,419 | A | 6/1923 | Oliphant | |
| 1,698,619 | A | 1/1929 | Blow | |
| 1,712,695 | A * | 5/1929 | Engstrand | 417/87 |
| 2,632,513 | A * | 3/1953 | Bennett | 166/106 |

(Continued)

FOREIGN PATENT DOCUMENTS

| | | | |
|---|---|---|---|
| CN | 87100504 | A | 8/1987 |
| DE | 4037899 | A1 | 6/1992 |

(Continued)

*Primary Examiner* — Devon Kramer
*Assistant Examiner* — Patrick Hamo
(74) *Attorney, Agent, or Firm* — Myers Bigel Sibley & Sajovec

(57) ABSTRACT

Embodiments of the invention provide liquid pump apparatus. The apparatus may comprise an immersion assembly comprising at least one immersion member having a liquid conduit provided therein along at least a portion of a length thereof, the immersion assembly being arranged whereby in use at least a portion of the immersion assembly is immersed in liquid to be pumped, the apparatus being arranged to provide a supply of gaseous fluid to liquid in the tank through the at least one immersion member at one of a plurality of vertically spaced apart locations of the assembly thereby to cause passage of liquid through the assembly from a liquid inlet aperture to a liquid outlet aperture of the assembly, the apparatus being configured whereby a location at which gaseous fluid is supplied to the immersion assembly is selected to be a location at which a head of pressure of liquid in the tank is within a prescribed range of values.

26 Claims, 3 Drawing Sheets

(56) References Cited

U.S. PATENT DOCUMENTS

| | | | | |
|---|---|---|---|---|
| 3,172,370 | A * | 3/1965 | Hoff | 417/108 |
| 3,393,519 | A * | 7/1968 | Mitchell | 405/55 |
| 3,427,989 | A * | 2/1969 | Bostock et al. | 417/112 |
| 3,433,174 | A * | 3/1969 | Chenoweth | 417/117 |
| 3,694,106 | A * | 9/1972 | Walker | 417/109 |
| 5,735,600 | A | 4/1998 | Wyness et al. | |
| 6,402,965 | B1 | 6/2002 | Sullivan et al. | |
| 2002/0174814 | A1* | 11/2002 | Hunter | 114/74 R |

FOREIGN PATENT DOCUMENTS

| | | | |
|---|---|---|---|
| DE | 19700202 | A1 | 7/1998 |
| EP | 0 232 000 | A1 | 8/1987 |
| FR | 2 809 179 | A1 | 11/2001 |
| GB | 150698 | | 8/1919 |
| GB | 624 385 | A | 6/1949 |
| GB | 1063388 | | 8/1964 |
| GB | 1241377 | | 5/1969 |
| GB | 2470070 | A | 10/2010 |
| JP | S5489366 | A | 7/1979 |
| JP | 56114897 | | 9/1981 |
| JP | S60227887 | | 11/1985 |
| JP | 1310200 | A | 12/1989 |
| JP | 2090982 | A | 3/1990 |
| JP | 2000240600 | A | 9/2000 |
| JP | 2006043674 | A | 2/2006 |
| JP | 2007113295 | A | 5/2007 |
| JP | 2007515289 | A | 6/2007 |
| JP | 2007229577 | A | 9/2007 |
| JP | 2009056442 | A | 3/2009 |
| RU | 2248469 | C1 | 3/2005 |
| SU | 500379 | A1 | 1/1976 |
| WO | WO 2005/061394 | A1 | 7/2005 |

* cited by examiner

LIQUID PUMP APPARATUS AND METHOD

RELATED APPLICATIONS

This application is a 35 U.S.C. §371 national stage application of PCT Application No. PCT/GB2010/050751, filed on 10 May 2010, which claims priority from Great Britain Patent Application No. 0907944.3, filed 8 May 2009, the contents of which are incorporated herein by reference in their entireties. The above-referenced PCT International Application was published in the English language as International Publication No. WO 2010/128336 A1 on 11 Nov. 2010.

FIELD OF THE INVENTION

The present invention relates to fluid pump apparatus. In particular but not exclusively the invention relates to apparatus for circulating liquid within a ballast tank of a vessel.

BACKGROUND

JP2007113295 discloses an air lift pump for excavating sediment and sludge that has deposited and hardened on a sub-aqueous bottom over a period of time. The pump has a riser pipe whose lower end header reaches as far as the sub-aqueous bottom; a nozzle which is enclosed by the header and sprays high-pressure fluid, and a blade for scraping material from the sub-aqueous bottom.

JP1207535 discloses an air lift pump for pumping mud from a water bottom such as a river bed.

STATEMENT OF THE INVENTION

In a first aspect of the invention there is provided liquid pump apparatus, the apparatus comprising: an immersion assembly comprising at least one immersion member having a liquid conduit provided therein along at least a portion of a length thereof, the immersion assembly being arranged whereby in use at least a portion of the immersion assembly is immersed in liquid to be pumped, the apparatus being arranged to provide a supply of gaseous fluid to liquid in the tank through the at least one immersion member at one of a plurality of vertically spaced apart locations of the assembly thereby to cause passage of liquid through the assembly from a liquid inlet aperture to a liquid outlet aperture of the assembly, the apparatus being configured whereby a location at which gaseous fluid is supplied to the immersion assembly is selected to be a location at which a head of pressure of liquid in the tank is within a prescribed range of values.

Embodiments of the invention have the advantage that pumping of liquid, for example to circulate or recirculate liquid in a liquid storage tank, may be reliably effected in a tank in which a level of liquid in the tank may vary over a relatively wide range. For example, a ballast tank of a ship or other vessel.

It may be required to circulate water, for example in order to increase a concentration of a gas in the water (such as carbon dioxide) whereby aquatic nuisance species may be killed.

A gas lift pump may be employed to circulate liquid in the tank, and to incorporate gas into the liquid as an integral part of the manner of operation of the gas lift pump. That is, the act of supplying gas to the immersion member of the gas lift pump in order to pump liquid through an inlet of the pump may be employed to increase an amount of the gas that is dissolved or otherwise incorporated into the liquid in order to achieve the purpose of killing aquatic nuisance species.

In some embodiments the gas is injected into the immersion member. Other methods of dissolving or otherwise incorporating a gas into the liquid are also useful.

A problem with known gas lift pumps is that as a pressure head of liquid in the liquid storage tank increases, increasingly high pressures of gas are required in order to force gas into a liquid conduit of the gas lift pump. The cost of providing apparatus to achieve these pressures is not insignificant. Furthermore, a weight and cost of the apparatus may be too high for a given application.

The present invention overcomes these problems by providing a supply of gas to a liquid conduit of a gas lift pump at different vertical positions in a liquid storage tank. As the liquid level in the tank increases, a vertical position at which gaseous fluid is supplied is changed (increased) in order to ensure that a pressure of gaseous fluid required in order to supply gas into a liquid conduit does not exceed a prescribed value or range of values.

Preferably the at least one immersion member has at least one liquid outlet aperture formed therein along at least a portion of a length of the fluid conduit thereof, the at least one outlet aperture being arranged to allow passage of liquid out from the immersion member therethrough.

The at least one liquid outlet aperture may be of substantially the same size as the liquid inlet aperture of the immersion member.

Thus, any particles, debris or aquatic species drawn into the immersion member through the liquid inlet aperture may be ejected through the liquid outlet aperture.

Preferably the liquid inlet aperture has a diameter in the range of from around 15 cm to around 80 cm, preferably in the range from around 20 cm to around 40 cm.

The immersion assembly may have a plurality of gaseous fluid inlets whereby the gaseous fluid may be supplied, the gaseous fluid inlets being provided at vertically spaced apart locations.

The at least one immersion member may have a plurality of gaseous fluid inlets, the plurality of gaseous fluid inlets being provided at vertically spaced apart locations of the at least one immersion member.

The apparatus may comprise a single immersion member.

Alternatively the immersion assembly may comprise a plurality of immersion members, each immersion member having a liquid conduit therein along at least a portion of a length thereof, each of the immersion members having a gaseous fluid inlet whereby gaseous fluid may be supplied to the liquid conduit thereof, respective gaseous fluid inlets of respective immersion members being provided at vertically spaced apart locations with respect to one another.

A plurality of the immersion members of the immersion assembly may have fluid conduits of different respective lengths.

Preferably the prescribed range is determined such that for a level of liquid at or above a level at which a lowest gaseous fluid inlet delivers a supply of gaseous fluid, at least one gaseous fluid inlet is arranged to deliver a supply of gaseous fluid at a given moment in time.

Alternatively or in addition a gaseous fluid inlet is arranged to be movable thereby to vary a vertical position at which gaseous fluid is supplied to the liquid conduit of the at least one immersion member.

The gaseous fluid inlet may be arranged to be provided substantially coaxial of the liquid conduit.

Preferably the gaseous fluid inlet is provided at a free end of a hose member, the hose member being arranged to be lowered into the liquid conduit of the at least one immersion member thereby to vary a vertical position at which gaseous fluid is supplied to the liquid conduit.

The apparatus may comprise a liquid level monitoring device, the apparatus being arranged to determine the vertical position at which gaseous fluid is supplied to the liquid conduit based on a level of liquid in the tank.

The liquid level monitoring device may be provided at a prescribed distance above each gaseous fluid inlet of the assembly.

Alternatively or in addition the apparatus may be arranged to determine the vertical position at which gaseous fluid is supplied to the liquid conduit based on a flow rate of gaseous fluid through a gaseous fluid inlet.

The liquid conduit of the at least one immersion member may be substantially L-shaped.

The liquid conduit of the at least one immersion member may comprise a substantially hollow tube member.

The tube member may be of substantially circular cross-section.

The gaseous fluid may be an inert gas. The gaseous fluid may comprise at least one selected from amongst carbon dioxide, nitrogen and oxygen. The gaseous fluid may substantially comprise carbon dioxide, nitrogen and oxygen. The gaseous fluid may consist essentially of carbon dioxide, nitrogen and oxygen.

In a second aspect of the invention there is provided a method of pumping liquid in a liquid storage tank comprising: providing an immersion assembly comprising at least one immersion member having a liquid conduit provided therein along at least a portion of a length thereof; immersing at least a portion of the immersion assembly in liquid to be pumped; providing a supply of gaseous fluid to liquid in the tank through the at least one immersion member at one of a plurality of vertically spaced apart locations of the assembly thereby to cause passage of liquid through the assembly from a liquid inlet aperture to a liquid outlet aperture of the assembly by gas lift; the method comprising selecting a vertical location at which gaseous fluid is supplied to the immersion assembly to be a location at which a head of pressure of liquid in the tank is within a prescribed range of values.

The method may further comprise increasing a concentration of the gaseous fluid dissolved in the liquid.

Preferably the gaseous fluid is a gaseous fluid selected to cause hypercapnia in aquatic nuisance species.

Preferably the gaseous fluid is carbon dioxide.

The liquid tank may be a ballast tank.

Preferably the ballast tank is a ballast tank of a ship.

In one aspect of the invention there is provided liquid pump apparatus for pumping liquid in a liquid storage tank, the apparatus comprising:

an immersion assembly comprising at least one immersion member having a liquid conduit provided therein along at least a portion of a length thereof, the immersion assembly being arranged whereby in use at least a portion of the immersion assembly is immersed in liquid to be pumped, the apparatus being arranged to provide a supply of gaseous fluid to liquid in the tank through the at least one immersion member at one of a plurality of vertically spaced apart locations of the assembly thereby to cause passage of liquid through the assembly from a liquid inlet aperture to a liquid outlet aperture of the assembly, the apparatus being configured whereby a location at which gaseous fluid is supplied to the immersion assembly may be selected according to a requirement of an operator of the apparatus.

BRIEF DESCRIPTION OF THE DRAWINGS

Embodiments of the invention will now be described with reference to the accompanying figures in which.

DETAILED DESCRIPTION

Figure 1:
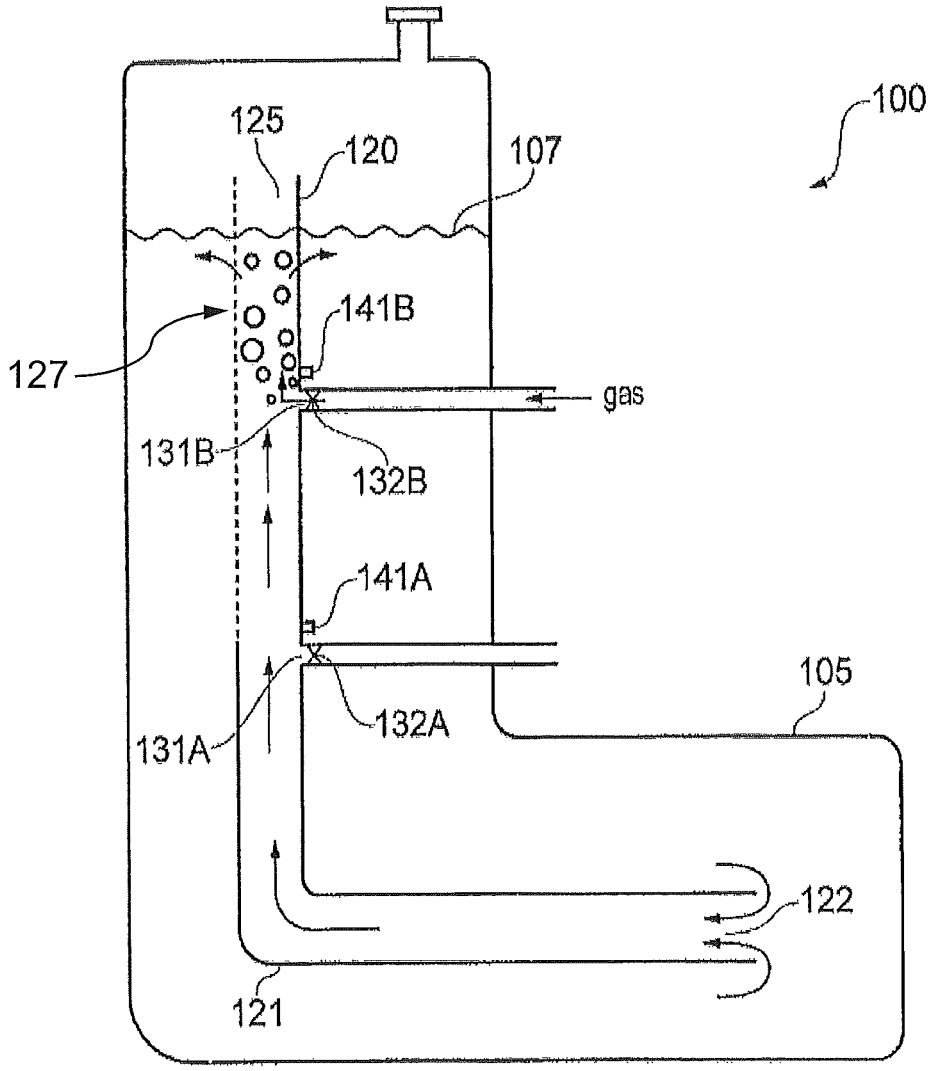
FIG. 1 shows an embodiment of the invention in which liquid pump apparatus is installed in a ballast tank of a vessel for circulating liquid in the tank.

FIG. 1 shows an embodiment of the invention in which liquid pump apparatus is provided for circulation of liquid in a liquid storage tank. The apparatus may also be referred to as liquid circulation apparatus.

The apparatus is provided in which an immersion member 120 in the form of a substantially hollow tube member 120 is provided in a substantially upright orientation within a ballast tank 105.

In the embodiment shown the tube member 120 is substantially 'L'-shaped, having a bend portion 121 arranged to enable a liquid inlet 122 at a free end of the tube member 120 to project into a volume of the ballast tank that is displaced in a lateral (i.e. substantially horizontal) direction with respect to a free surface 107 of liquid within the tank 105.

The tube member 120 has two gas inlets 131A, 131B through which gas may be forced into an inner volume 125 of the tube member 120. The inlets are provided at vertically spaced apart locations along a length of the tube member 120.

Valves 132A, 132B are provided at the respective inlets 131A, 131B to allow the apparatus to control a flow of gas into the tube member 120.

In the embodiment shown in FIG. 1 a liquid level sensor 141A, 141B is provided above each of the gas inlets 131A, 131B. The purpose of the liquid level sensor 141A, 141B is to provide a signal to a controller of the apparatus indicating that a level of liquid has exceeded the level of the respective gas inlet 131A, 131B.

Other locations of liquid level sensor are also useful. For example, in some embodiments a liquid level sensor arranged to determine a liquid level by measuring a head of pressure of liquid at a prescribed location, such as a lower region of the tank 105, may be employed. Other liquid level sensors are also useful.

The apparatus is arranged to supply a flow of gas through the gas inlet 131A if the liquid level sensor 141A associated with inlet 131A indicates the presence of liquid at the level of sensor 141A unless liquid level sensor 141B indicates the presence of liquid at the level of sensor 141B. In this case, the apparatus is arranged to allow a flow of gas through gas inlet 131B and not through gas inlet 131A.

It is to be understood that more than two gas inlets and corresponding liquid level sensors may be provided, the apparatus being arranged to allow a flow of gas through the gas inlet corresponding to the highest gas inlet having a liquid level sensor 141A, 141B associated therewith indicating the presence of liquid at the level of that liquid level sensor 141A, 141B.

Other arrangements are also useful. Thus, a gas inlet through which a flow of gas is allowed may be selected based on a level of liquid in the fluid tank as determined by a separate fluid level measuring device.

The tube member 120 has liquid outlet apertures 127 (FIG. 1) formed therein, arranged to allow passage of liquid out from the tube member 120 therethough.

Figure 2:
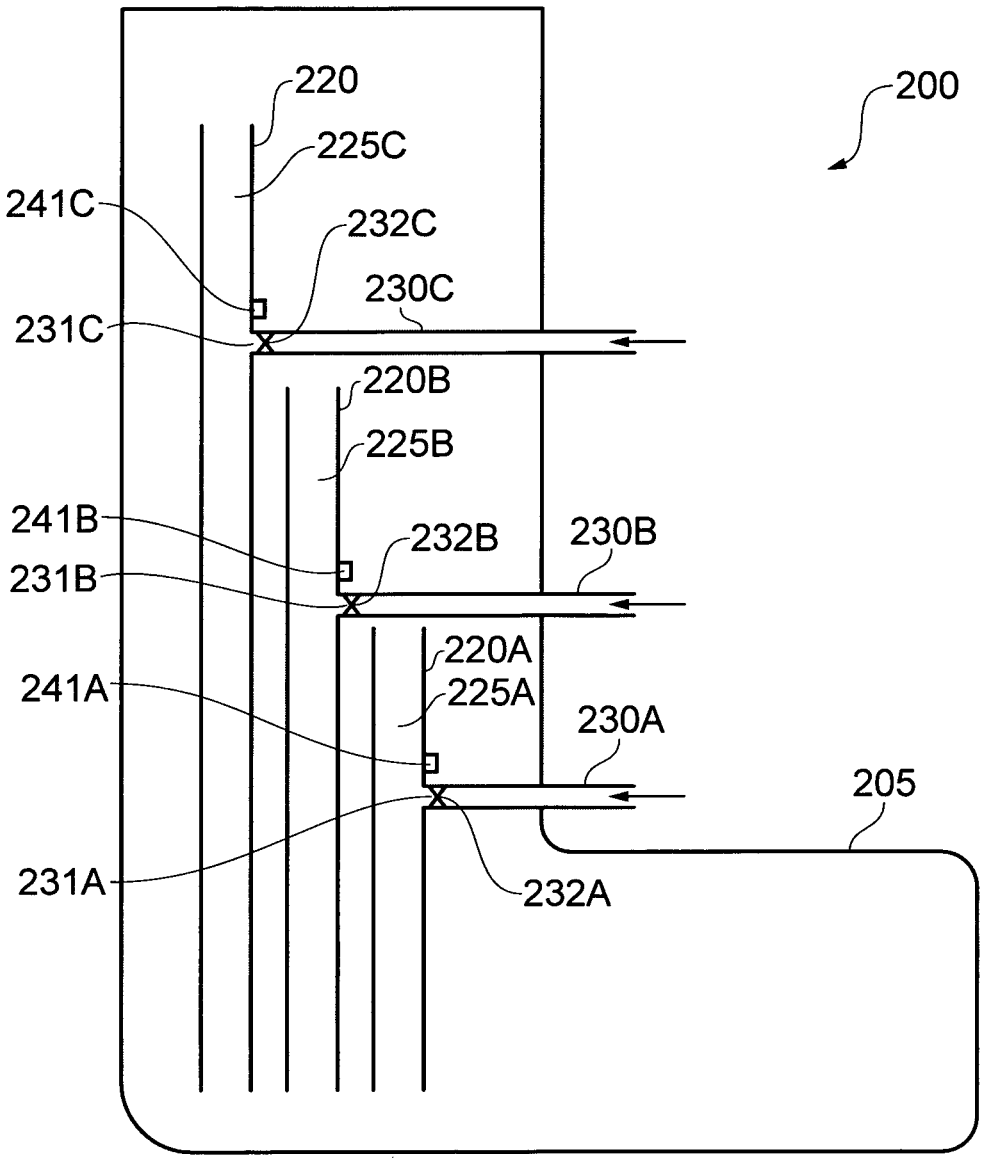
FIG. 2 shows a further embodiment of the invention in which liquid pump apparatus is installed in a ballast tank of a vessel.

FIG. 2 shows a further embodiment of the invention in which more than one tube member is provided. In the embodiment of FIG. 2 three tube members 220A, 220B, 220C are provided. It is to be understood that any suitable number of tube members may be provided.

In the embodiment shown each tube member 220A, 220B, 220C has a single gas inlet 231A, 231B, 231C through which gas may be forced into an inner volume 225A, 225B, 225C of a respective tube member 220A, 220B, 220C. A check valve 232A, 232B, 232C is provided at each gas inlet 231A, 231B, 231C for this purpose.

Each tube member has a liquid level sensor 241A, 241B, 241C respectively provided above the corresponding gas inlet 231A, 231B, 231C. Once a level of liquid in the fluid tank 205 reaches or exceeds a level of the liquid level sensor 241A, 241B, 241C, the apparatus is arranged to allow gaseous fluid to pass into the respective tube member 220A, 220B, 220C associated with the level sensor 241A, 241B, 241C. If gaseous fluid is being supplied to any other tube member 220A, 220B, 220C when a further liquid level sensor 241A, 241B, 241C is actuated, supply of gaseous fluid to the other tube member 220A, 220B, 220C is terminated when the further liquid level sensor 241A, 241B, 241C is actuated, in a similar manner to the embodiment of FIG. 1. Other arrangements are also useful.

Figure 3:
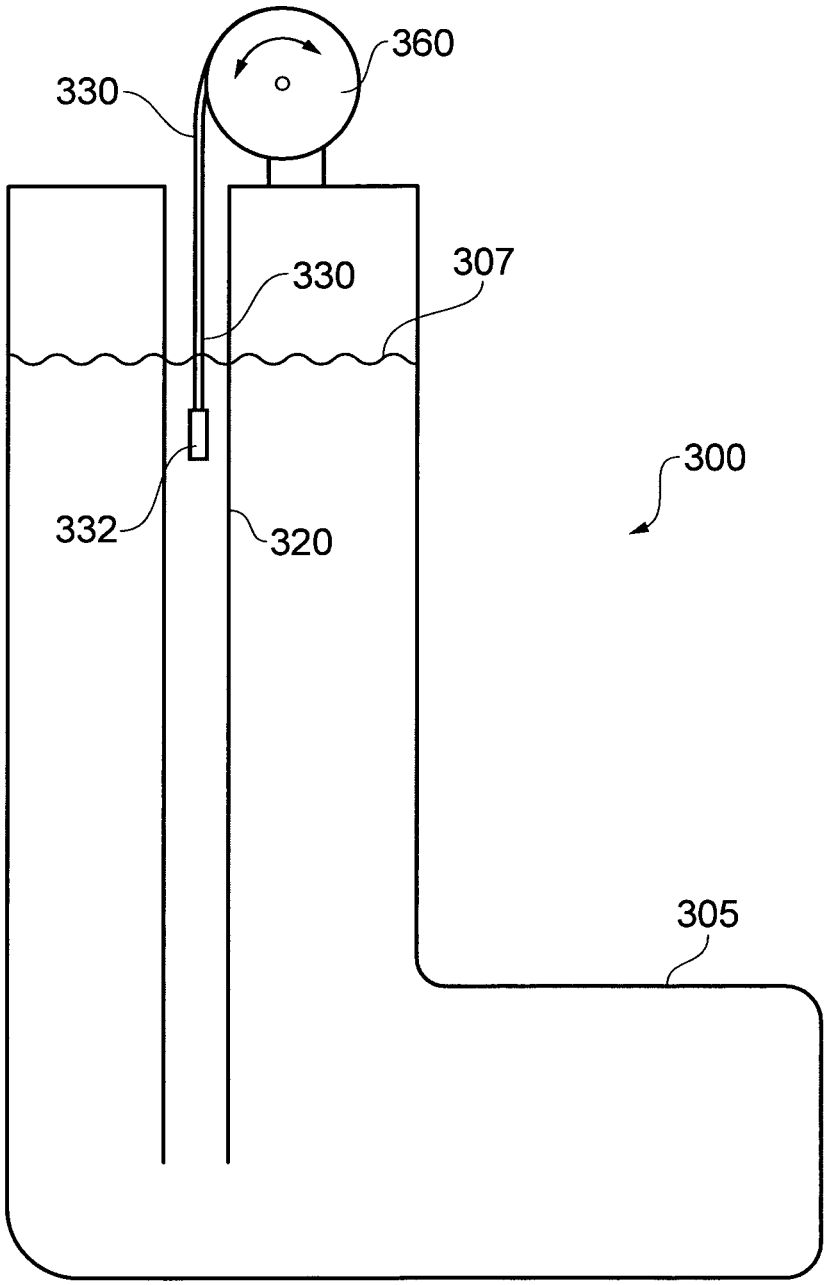
FIG. 3 shows a still further embodiment of the invention in which liquid pump apparatus is installed in a ballast tank of a vessel.

FIG. 3 shows apparatus 300 according to an embodiment of the invention in which a gas inlet 332 for a tube member 320 is arranged to be movable in a vertical direction along at least a portion of a length of the tube member 320. In the embodiment shown the gas inlet 332 is provided at a free end of a hose 330 arranged to be wound on a drum 360. It is to be understood that the gas inlet 332 may be raised or lowered by winding of the drum 360.

The apparatus 300 is arranged to determine a level 307 of liquid in the fluid tank 305 and to position the gas inlet 332 a suitable distance below the level 307 to provide effective circulation of fluid in the tank.

In some embodiments a fluid level monitoring device is provided whereby the apparatus is arranged to determine a required vertical position of the gas inlet 332.

In some embodiments, instead of providing a fluid level monitoring device, the apparatus 300 is arranged to determine a level at which gaseous fluid is to be supplied to the tube member 320 by providing a prescribed pressure of gaseous fluid to the gas inlet 332 and lowering the gas inlet 332 until a flow rate of gaseous fluid through the gas inlet falls below a prescribed value due to the increasing head of pressure at the gas inlet 332.

As a level of liquid in the tank 305 changes, for example due to discharge of liquid or addition of liquid, the apparatus is arranged to adjust a position of the gas inlet 332 is adjusted accordingly.

Other arrangements are also useful.

The gas inlet 332 may be arranged to be self-centering within the tube member 320. In other words, the gas inlet 332 may be arranged to be positioned substantially coaxially of the tube member when gas is flowing out from the gas inlet 332. Positions of nozzles through which gas flows out from the gas inlet 332 may be arranged to cause the gas inlet 332 to be self-centering. For example the nozzles may be arranged to direct gas in a radial direction out from the inlet 332.

Reference herein to a vessel includes reference to any boat, ship, or other floating structure having at least one ballast tank in the form of a liquid storage tank.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. An apparatus that recirculates liquid in a liquid storage tank, the apparatus comprising:

an immersion assembly comprising at least one immersion member having a liquid conduit provided therein along at least a portion of a length thereof, the liquid conduit comprising opposite open free ends, wherein one open free end is a liquid inlet aperture and the other open free end is a liquid outlet aperture, and a plurality of liquid outlet apertures formed therein in vertically spaced apart relationship along a portion of a length of the liquid conduit, the plurality of liquid outlet apertures being arranged to allow passage of liquid out from the liquid conduit, and wherein the at least one immersion member is configured to be disposed within the liquid storage tank such that the open free ends of the liquid conduit are within the liquid storage tank, the immersion assembly being arranged whereby in use at least a portion of the immersion assembly is immersed in liquid to be pumped, the apparatus being arranged to provide a supply of gaseous fluid to liquid in the tank through the at least one immersion member at one of a plurality of vertically spaced apart locations of the assembly thereby to cause passage of liquid through the assembly from the liquid inlet aperture to the liquid outlet aperture of the assembly, the apparatus being configured whereby a location at which gaseous fluid is supplied to the immersion assembly is selected to be a location at which a head of pressure of liquid in the tank is within a prescribed range of values.

2. An apparatus as claimed in claim 1 wherein the liquid outlet aperture is of substantially the same size as the liquid inlet aperture of the immersion member.

3. An apparatus as claimed in claim 1 wherein the liquid inlet aperture has a diameter in the range of from around 15 cm to around 80 cm.

4. An apparatus as claimed in claim 1 wherein the immersion assembly has a plurality of gaseous fluid inlets whereby the gaseous fluid may be supplied to the at least one immersion member, the gaseous fluid inlets being provided at vertically spaced apart locations.

5. An apparatus as claimed in claim 1 wherein the at least one immersion member has a plurality of gaseous fluid inlets, the plurality of gaseous fluid inlets being provided at vertically spaced apart locations of the at least one immersion member.

6. An apparatus as claimed in claim 5 wherein the immersion assembly comprises a single immersion member.

7. An apparatus as claimed in claim 1 wherein the immersion assembly comprises a plurality of immersion members, each immersion member having a liquid conduit therein along at least a portion of a length thereof, each of the immersion members having a gaseous fluid inlet whereby gaseous fluid may be supplied to the liquid conduit thereof, respective gaseous fluid inlets of respective immersion members being provided at vertically spaced apart locations with respect to one another.

8. An apparatus as claimed in claim 7 wherein a plurality of the immersion members of the immersion assembly have fluid conduits of different respective lengths.

9. An apparatus as claimed in claim 1 wherein the prescribed range is determined such that for a level of liquid in the liquid tank at or above a level at which a lowest gaseous fluid inlet delivers a supply of gaseous fluid, at least one gaseous fluid inlet is arranged to deliver a supply of gaseous fluid at a given moment in time.

10. An apparatus as claimed in claim 1 wherein a gaseous fluid inlet is arranged to be movable thereby to vary a vertical position at which gaseous fluid is supplied to the liquid conduit of the at least one immersion member.

11. An apparatus as claimed in claim 10 wherein the gaseous fluid inlet is arranged to be provided substantially coaxial of the liquid conduit.

12. An apparatus as claimed in claim 10 wherein the gaseous fluid inlet is provided at a free end of a hose member, the hose member being arranged to be lowered into the liquid conduit of the at least one immersion member thereby to vary a vertical position at which gaseous fluid is supplied to the liquid conduit.

13. An apparatus as claimed in claim 1 comprising a liquid level monitoring device, the apparatus being arranged to determine the vertical position at which gaseous fluid is supplied to the liquid conduit based on a level of liquid in the tank.

14. An apparatus as claimed in claim 4, comprising a plurality of liquid level monitoring devices, the apparatus being arranged to determine the vertical position at which gaseous fluid is supplied to the liquid conduit based on a level of liquid in the tank, wherein a respective one of the liquid level monitoring devices is provided at a prescribed distance above each gaseous fluid inlet of the assembly.

15. An apparatus as claimed in claim 1 arranged to determine the vertical position at which gaseous fluid is supplied to the liquid conduit based on a flow rate of gaseous fluid through a gaseous fluid inlet.

16. An apparatus as claimed in claim 1 wherein the liquid conduit of the at least one immersion member is substantially L-shaped.

17. An apparatus as claimed in claim 1 wherein the liquid conduit of the at least one immersion member comprises a substantially hollow tube member.

18. An apparatus as claimed in claim 17 wherein the tube member is of substantially circular cross-section.

19. An apparatus as claimed in claim 1 wherein the gaseous fluid is an inert gas.

20. An apparatus as claimed in claim 1 wherein the gaseous fluid comprises at least one selected from amongst carbon dioxide, nitrogen and oxygen.

21. An apparatus as claimed in claim 20 wherein the gaseous fluid substantially comprises carbon dioxide, nitrogen and oxygen.

22. An apparatus as claimed in claim 20 wherein the gaseous fluid consists essentially of carbon dioxide, nitrogen and oxygen.

23. An apparatus as claimed in claim 1 wherein the gaseous fluid is carbon dioxide.

24. A liquid storage tank comprising the apparatus of claim 1.

25. A ballast tank for a marine vessel comprising the apparatus of claim 1.

26. A vessel having a ballast tank comprising the apparatus of claim 1.

* * * * *